US006925981B2

(12) United States Patent
Ibukuro et al.

(10) Patent No.: US 6,925,981 B2
(45) Date of Patent: Aug. 9, 2005

(54) PROCESS FOR PRODUCING A CYLINDER BLOCK WITH A SLEEVE

(75) Inventors: Hideo Ibukuro, Saitama (JP); Tadashi Kato, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 154 days.

(21) Appl. No.: 10/646,691

(22) Filed: Aug. 25, 2003

(65) Prior Publication Data

US 2004/0060684 A1 Apr. 1, 2004

(30) Foreign Application Priority Data

Sep. 11, 2002 (JP) ..... 2002-266034

(51) Int. Cl.[7] ..... F02F 1/00
(52) U.S. Cl. ..... 123/193.2
(58) Field of Search ..... 123/193.2, 193.3; 29/888.06, 888.061

(56) References Cited

U.S. PATENT DOCUMENTS 4,883,030 A * 11/1989 Tanahashi et al. ..... 123/193.3
5,050,547 A * 9/1991 Takahashi ..... 123/193.2
5,398,649 A 3/1995 Shimamoto
5,463,898 A 11/1995 Blander et al.
5,887,558 A * 3/1999 Kampichler et al. ..... 123/193.2
5,967,109 A * 10/1999 Bruce et al. ..... 123/193.2
6,363,995 B1 4/2002 Baranzke

FOREIGN PATENT DOCUMENTS

| | | |
|---|---|---|
| DE | 4230596 A1 | 3/1994 |
| EP | 1226889 A2 | 7/2002 |
| JP | 61124772 | 6/1986 |
| JP | 2000-213410 | 8/2000 |
| JP | 2002-188509 | 7/2002 |

* cited by examiner

*Primary Examiner*—Marguerite McMahon
(74) *Attorney, Agent, or Firm*—Birch, Stewart, Kolasch & Birch, LLP

(57) ABSTRACT

To provide a process for producing a cylinder block with a sleeve in which arc recesses for avoiding interference with the umbrella portions of valves are formed at an intersection between a deck face and a cylinder bore. A sleeve is cast in such a manner that it is embedded in a cylinder block with a space from a deck face simultaneously with the molding of the opening end portion of a cylinder bore and recesses in the cylinder block in the space with a bore pin mated with a sleeve.

12 Claims, 5 Drawing Sheets

PROCESS FOR PRODUCING A CYLINDER BLOCK WITH A SLEEVE

CROSS-REFERENCE TO RELATED APPLICATIONS

This nonprovisional application claims priority under 35 U.S.C. § 119(a) on Patent Application No. 2002-266034, filed in Japan on Sep. 11, 2002, the entirety of which is incorporated herein by reference.

BACKGROUND OF THE INVENTION

1. Field of the Invention

The present invention relates to a process for producing a cylinder block with a sleeve. In particular, the present invention relates to a process for producing a cylinder block with a sleeve, which includes forming arc recesses for avoiding interference with the umbrella portions of valves mounted in a cylinder head at an intersection between a deck face joined to the cylinder head and a cylinder bore.

2. Description of Background Art

Japanese Laid-open Patent Application No. 61-124772 has disclosed a cylinder block with a sleeve. In this document, an engine includes a suction port formed therein to a maximum diameter. The suction port is opened or closed by suction valves having a large-diameter umbrella portion to enhance the filling efficiency of the engine. When the umbrella portions are advanced into the cylinder bore by the opening of the suction valves, arc recesses are formed at an intersection between the deck face of a cylinder block and the cylinder bore to avoid interference with the deck face of the cylinder block and further to prevent the reduction of suction by a masking effect due to a small clearance in other background art engines. In the production of the cylinder block with a sleeve of the above background art document, the cylinder block is cast while it contains the sleeve and then arc recesses are formed by cutting at an intersection between the deck face of the cylinder block and the cylinder bore.

However, as described above, much time and labor are required to cut the above recesses after the casting of the cylinder block. This makes it difficult to reduce the production cost of the cylinder block with a sleeve.

SUMMARY OF THE INVENTION

It is an object of the present invention, which has been made in view of the above situation, to provide a process for producing a cylinder block with a sleeve, wherein the step of forming the recesses is performed at the time of casting the cylinder block to avoid the necessity of the post-processing of the recesses. This makes it possible to the cut production cost of the engine.

To attain the above object, in the production of a cylinder block with a sleeve in which arc recesses for avoiding interference with the umbrella portions of valves mounted in a cylinder head are formed at an intersection between a deck face joined to the cylinder head and a cylinder bore, the first feature of the present invention includes the steps of casting the sleeve such that it is embedded in the cylinder block with a space from the deck face simultaneously with the formation of the open end portion of the cylinder bore and the above recesses in the space using a bore pin mated with the sleeve to support the sleeve.

According to the first feature, the above arc recesses are formed by using the bore pin mated with the sleeve simultaneously with the casting of the cylinder block containing the sleeve. This makes it possible to simplify the production process by avoiding the necessity of the post-processing of the recesses after the casting of the cylinder block and to greatly cut the production cost of the engine.

The second feature of the present invention is in addition to the first feature, and includes the step of making the sleeve and the cylinder block from an aluminum alloy.

According to the second feature, the diffusion of the raw materials occurs effectively at the boundary between the sleeve and the cylinder block at the time of casting the cylinder block. Accordingly, the sleeve and the cylinder block are assembled together without fail to enhance the heat conductivity of the cylinder block with a sleeve.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will now be described with reference to the accompanying drawings.

Figure 1:
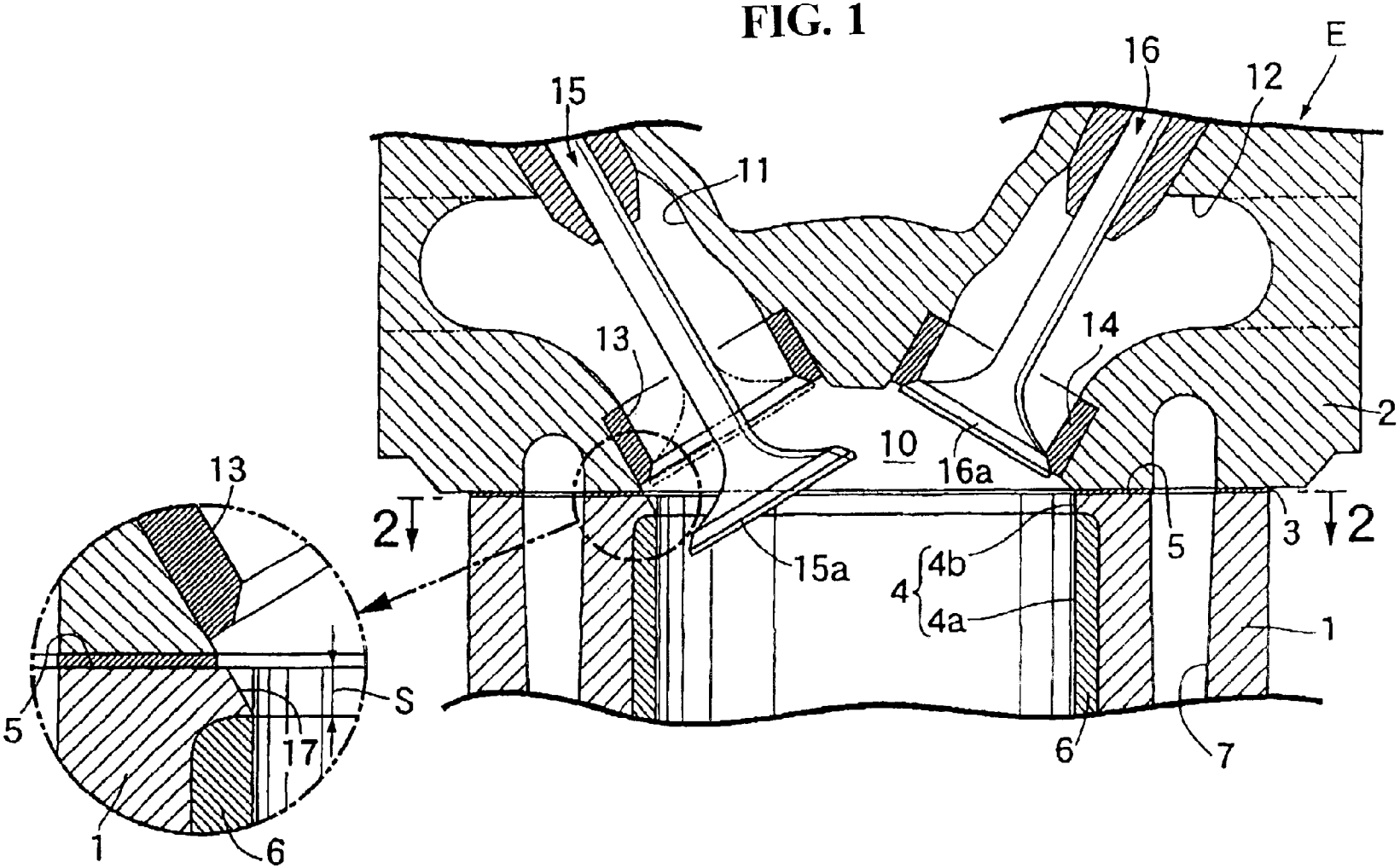
FIG. 1 is a longitudinal sectional view of the key section of an engine having a cylinder block with a sleeve produced by the process of the present invention.
Figure 2:
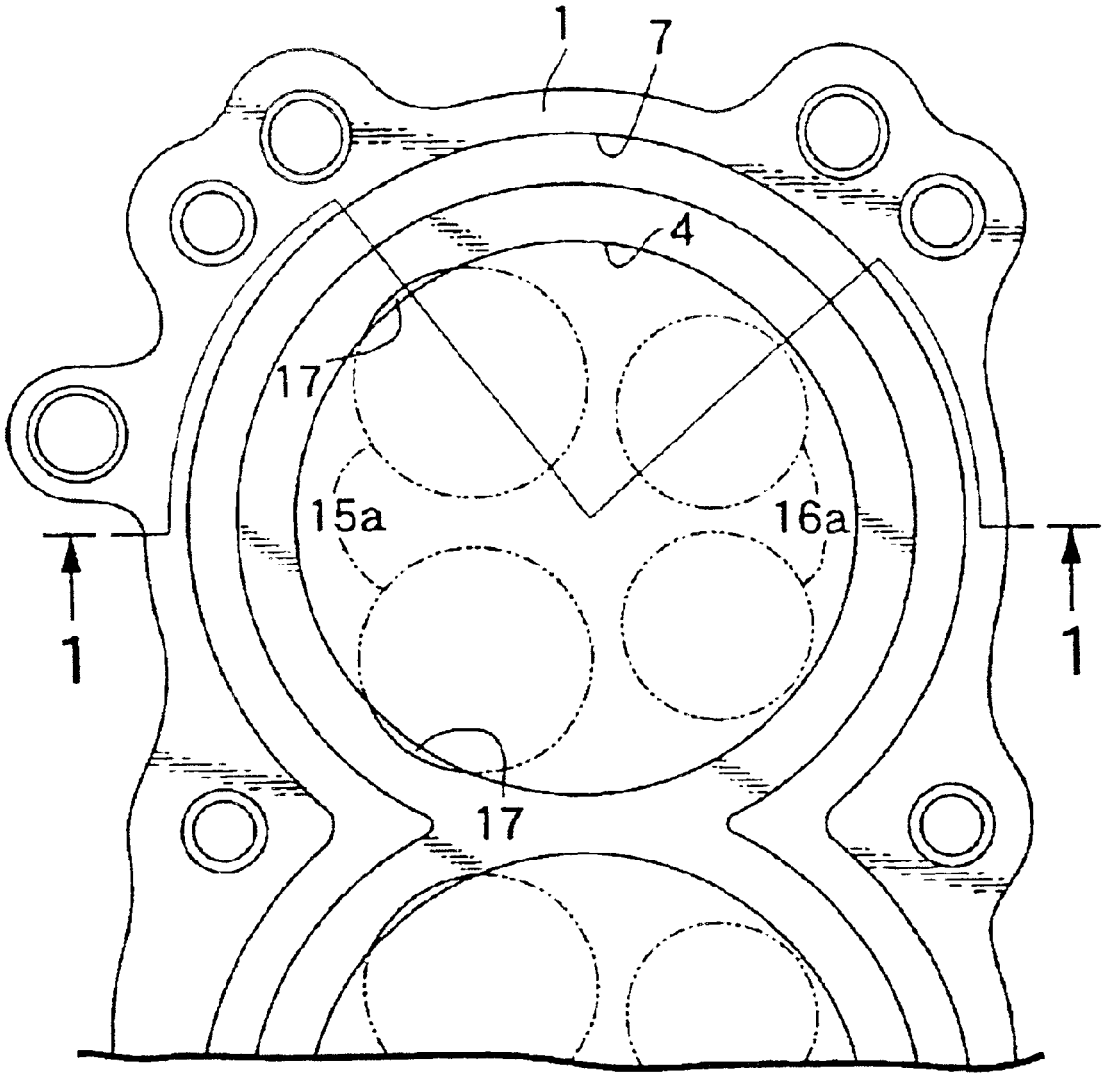
FIG. 2 is a cross-sectional view along the line 2—2 of FIG. 1.

Referring to FIGS. 1 and 2, the construction of the engine having a cylinder block with a sleeve produced by the process of the present invention will be described.

The engine E comprises a cylinder block 1 having a cylinder bore 4 and a water jacket 7. A cylinder head 2 is joined to the deck face 5. The cylinder bore 4 is opened toward the deck face 5 of the cylinder block 1 through a gasket 3. A sleeve 6 is cast such that it is embedded in the cylinder block 1 with a predetermined space S from the deck face 5. The cylinder bore 4 includes the inner face 4*a* of the sleeve 6 and a bore opening end portion 4*b* formed on the cylinder block 1 in the above space S in such a manner that it is continuous to the inner face 4*a* of the sleeve 6.

A combustion chamber 10 facing the cylinder bore 4, a suction port 11 and an exhaust port 12 are formed in the cylinder head 2. The suction port 11 and the exhaust port 12 are arranged in the shape of a fork and are opened into the combustion chamber 10. Valve seats 13 and 14 are secured to fork end portions of the suction port 11 and the exhaust port 12, which are opened to the combustion chamber 10. Furthermore, a pair of poppet suction valves 15 and a pair of poppet exhaust valves 16 for opening and closing the suction port 11 and the exhaust port 12 in cooperation with the valve seats 13 and 14 are mounted in the cylinder head 2, respectively. It should be noted that only one poppet suction valve 15 and one poppet suction valve 16 is illustrated in FIG. 1.

The suction port 11 and the umbrella portions 15*a* of the suction valves 15 have a larger diameter than the exhaust port 12 and the umbrella portions 16*a* of the exhaust valves 16 to enhance filling efficiency. Part of the deck face 5 of the cylinder block 1 exists within the plane of projection in the opening and closing direction of the umbrella portions 15*a* of the suction valves 15. Therefore, when the umbrella portions 15*a* and 15*a* are advanced into the cylinder bore 4 to open the pair of suction valves 15 and 15, the umbrella portions 15*a* and 15*a* would interfere with the deck face 5 of the cylinder block 1. To avoid this interference, a pair of recesses 17 and 17 in the shape of an arc is formed from the deck face 5 to the bore opening end portion 4*b*.

Figure 3:
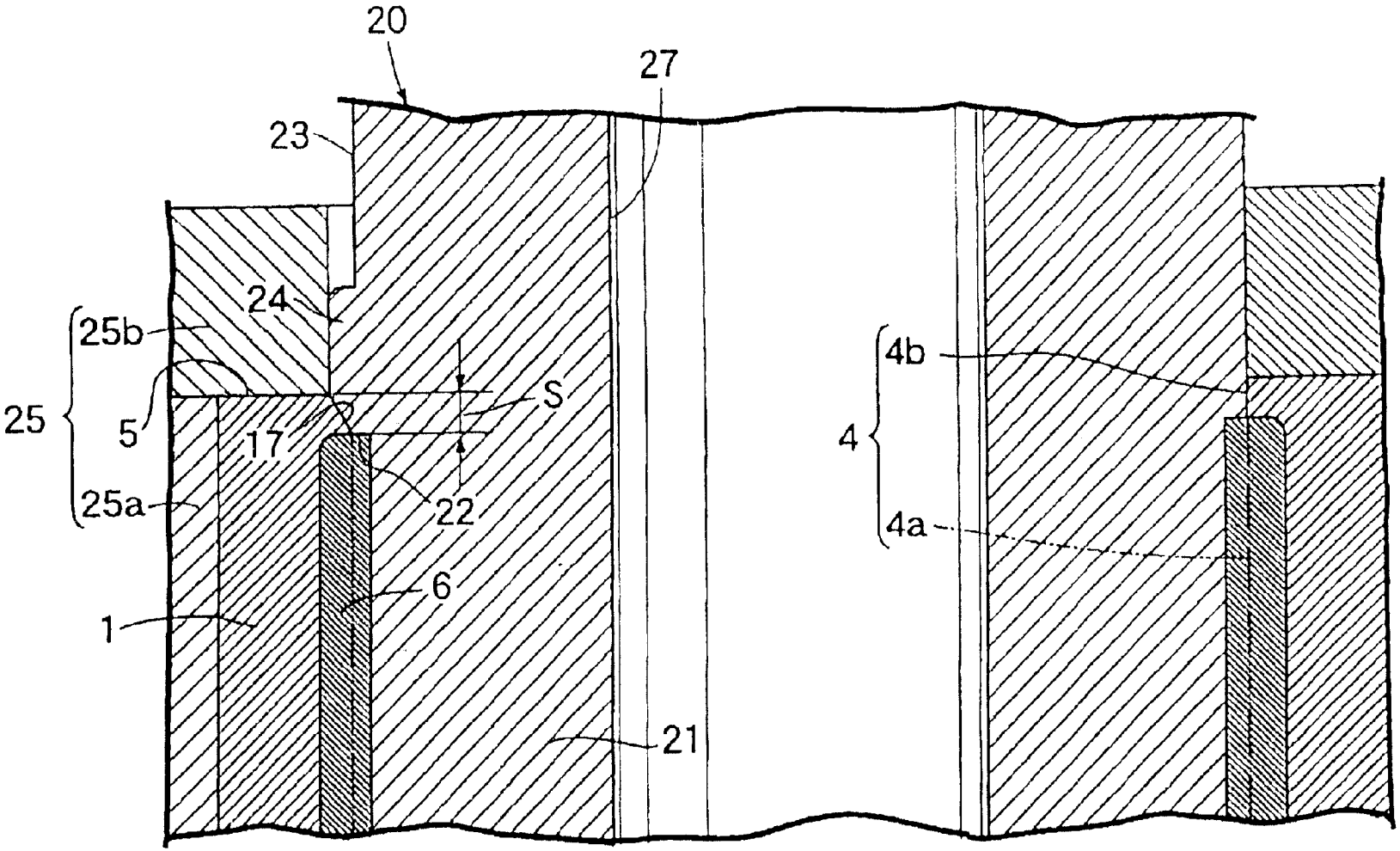
FIG. 3 is a diagram for explaining a process for producing the above cylinder block with a sleeve according to the present invention.
Figure 4:
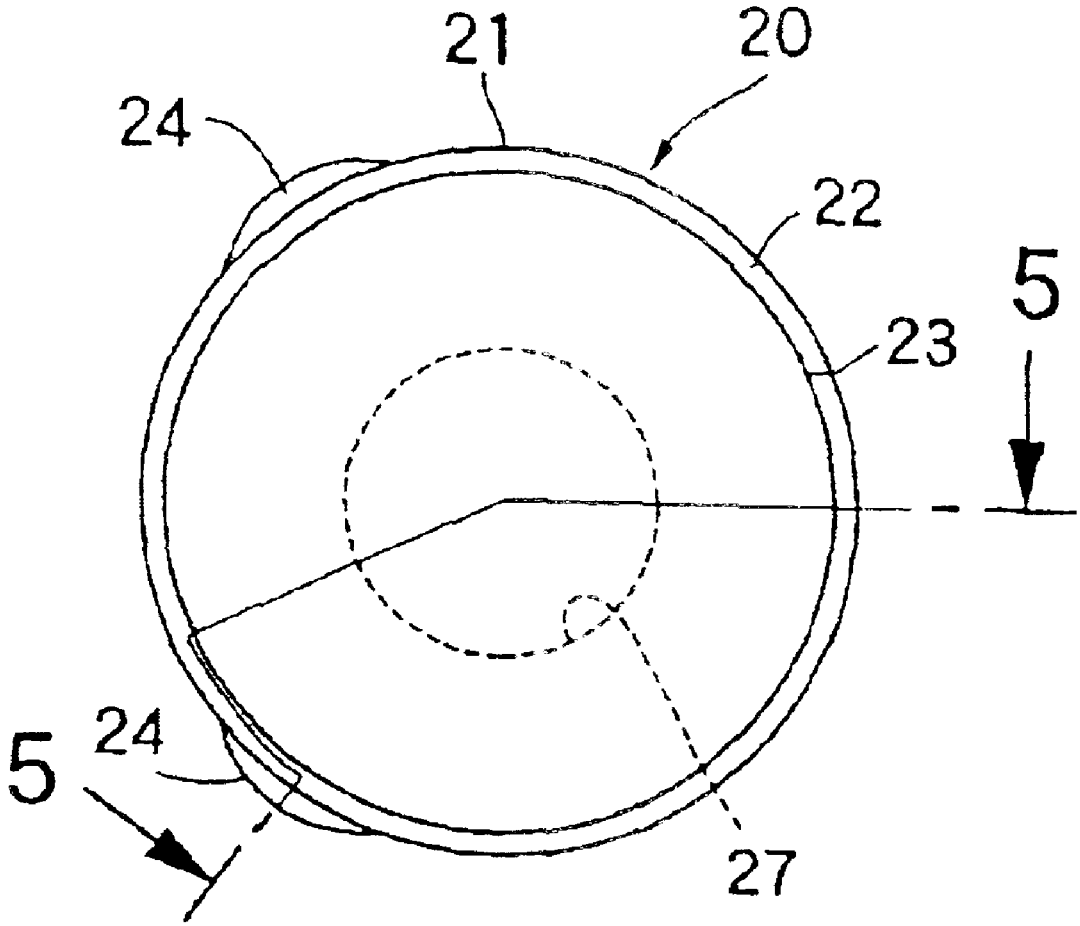
FIG. 4 is a bottom view of a bore pin used for the above production according to the present invention.
Figure 5:
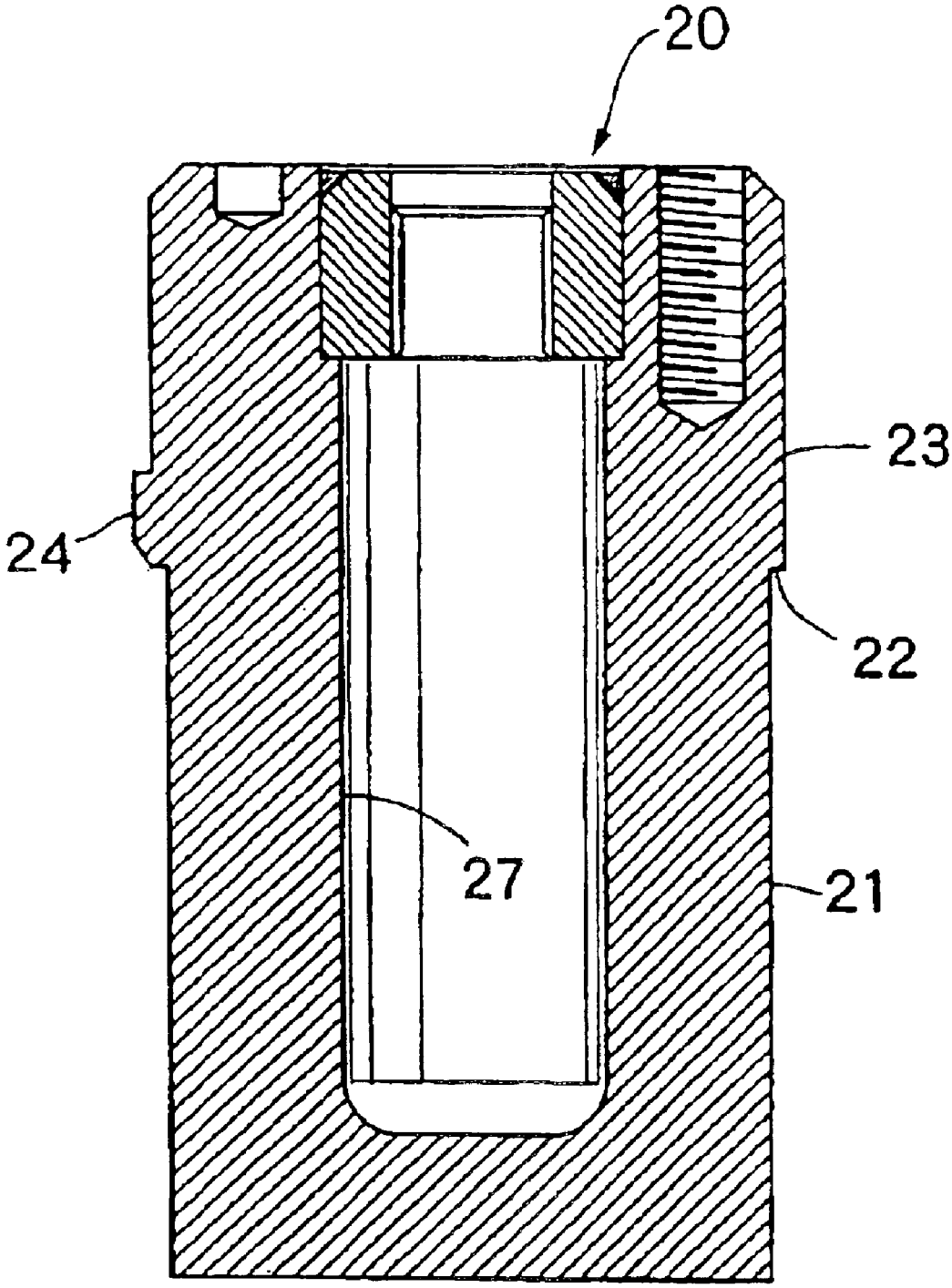
FIG. 5 is a cross-sectional view along the line 5—5 FIG. 4.

The process for producing a cylinder block 1 with a sleeve having the above recesses 17 and 17 will now be described with reference to FIGS. 3 to 5.

An aluminum alloy sleeve 6 is first prepared. The inner diameter of the sleeve 6 is set smaller than the normal inner diameter of the above cylinder bore 4, taking into account post-processing length.

A bore pin 20 for supporting the sleeve 6 is mated with the sleeve 6. As shown in FIGS. 4 and 5, the bore pin 20 has a cylindrical large-diameter portion 23 having a slightly larger diameter than a sleeve mating portion 21. The large-diameter portion 23 is continuous to the sleeve mating portion 21 through a ring stepped portion 22 and a pair of arc projections 24 and 24 projecting from the peripheral surface of the large-diameter portion 23. The large-diameter portion 23 corresponds to the shape of the above bore opening end portion 4*b*, and the projections 24 and 24 correspond to the shape of the above recesses 17 and 17. The cylindrical sleeve mating portion 21 mates with the sleeve 6. Furthermore, a cooling water jacket 27 is formed at the center of the bore pin 20.

The sleeve 6 is then set in the metal mold 25 of a casting machine, for example, a die cast machine together with the bore pin 20. The metal mold 25 includes a first mold 25*a* having a cavity 26 for molding the cylinder block which stores the sleeve 6 and a second metal mold 25*b* for closing the opening end face of the cavity 26. The inner face of the second metal mold 25*b* corresponds to the above deck face 5. Therefore, to set the sleeve 6 in the cavity 26 of the first metal mold 25*a*, the sleeve 6 is sunken in the cavity 26 by a distance corresponding to the above space S from the inner face of the second metal mold 25*b*. Thereafter, a molten aluminum alloy is filled into the cavity 26, whereby the cylinder block 1 containing the sleeve 6 is molded. At the same time, the above bore opening end portion 4*b* and the above recesses 17 and 17 are molded in the cylinder block 1 using the large-diameter portion 23 and the projections 24 and 24 of the bore pin 20, respectively.

After the cylinder block 1 with a sleeve is cast, the inner face 4*a* of the sleeve 6 and/or the bore opening end portion 4*b* is cut to form a normal cylinder bore 4 having a uniform diameter.

Since the arc recesses 17 and 17 are molded using the bore pin 20 mated with the sleeve 6 simultaneously with the casting of the cylinder block 1 containing the sleeve 6, it is possible to simplify the production process by avoiding the necessity of the post-processing of the recesses 17 and 17 after casting and to greatly cut the production cost.

Since the sleeve 6 made from an aluminum alloy is embedded in the cylinder block 1 made from an aluminum alloy, the diffusion of the raw materials into each other occurs effectively at the boundary between the sleeve 6 and the cylinder block 1. Accordingly, the sleeve 6 and the cylinder block 1 are assembled together without fail to enhance the heat conductivity of the cylinder block 1 with a sleeve.

The present invention is not limited to the above embodiment and various design changes and modifications may be made without departing from the scope of the present invention. For example, the present invention can be applied to a situation where it is necessary to avoid interference between the umbrella portions 16*a* of the exhaust valves 16, if formed to a maximum diameter, and the deck face 5 of the cylinder block 1. In other words, it is also possible to form arc recesses 17 and 17 at an intersection between the deck face 5 and the cylinder bore 4 in order to avoid interference between the umbrella portions 16*a* of the exhaust valves 16 and the deck face 5 of the cylinder block 1.

According to the first feature of the present invention, in order to produce a cylinder block with a sleeve in which arc recesses for avoiding interference with the umbrella portions of valves mounted in a cylinder head are formed at an intersection between a deck face joined to the cylinder head and a cylinder bore, the sleeve is cast such that it is embedded in the cylinder block with a space from the deck face. At the same time, the opening end portion of the cylinder bore and the recesses are molded in the cylinder block in the above space using a bore pin mated with the sleeve to support the sleeve. Therefore, the arc recesses can be molded with the bore pin simultaneously with the casting of the cylinder block containing the sleeve. Consequently, it is possible to simplify the production process by avoiding the necessity of the post-processing of the recesses after the casting of the cylinder block and to greatly cut the production cost.

According to the second feature of the present invention, in addition to the above first feature, the sleeve and the cylinder block are made from an aluminum alloy. Accordingly, diffusion of the raw materials into each other occurs effectively at the boundary between the sleeve and the cylinder block at the time of casting the cylinder block. In view of this, the sleeve and the cylinder block are assembled together without fail to enhance the heat conductivity of the cylinder block with a sleeve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for producing a cylinder block with a sleeve said cylinder block having arc recesses formed at an intersection between a deck face joined to a cylinder head and a cylinder bore for avoiding interference with umbrella portions of valves mounted in the cylinder head, said process comprising the step of casting a sleeve such that it is embedded in the cylinder block spaced from the deck face simultaneously with molding of an opening end portion of the cylinder bore and the recesses in the cylinder block in said space using a bore pin mated with said sleeve to support said sleeve.

2. The process for producing a cylinder block with a sleeve according to claim 1, wherein said sleeve and said cylinder block are made from an aluminum alloy.

3. The process for producing a cylinder block with a sleeve according to claim 1, wherein said bore pin includes a first diameter portion for mating with said sleeve and a second diameter portion for forming said opening end portion of said cylinder bore, said second diameter portion being larger than said first diameter portion for forming said opening end portion of said cylinder bore having a larger diameter than an inner face of said sleeve.

4. The process for producing a cylinder block with a sleeve according to claim 2, wherein said bore pin includes a first diameter portion for mating with said sleeve and a second diameter portion for forming said opening end portion of said cylinder bore, said second diameter portion being larger than said first diameter portion for forming said opening end portion of said cylinder bore having a larger diameter than an inner face of said sleeve.

5. The process for producing a cylinder block with a sleeve according to claim 3, wherein said second diameter portion also includes projections formed thereon for forming said recesses.

6. The process for producing a cylinder block with a sleeve according to claim 4, wherein said second diameter portion also includes projections formed thereon for forming said recesses.

7. The process for producing a cylinder block with a sleeve according to claim 3, further comprising the step of cutting the inner face of said sleeve to have a diameter the same as the diameter of said opening end portion of said cylinder bore.

8. The process for producing a cylinder block with a sleeve according to claim 4, further comprising the step of cutting the inner face of said sleeve to have a diameter the same as the diameter of said opening end portion of said cylinder bore.

9. A cylinder block with a sleeve made by the process of claim 1.

10. A cylinder block with a sleeve said cylinder block having arc recesses formed at an intersection between a deck face joined to a cylinder head and a cylinder bore for avoiding interference with umbrella portions of valves mounted in the cylinder head, said cylinder block comprising:

a body, said body having a cylinder bore formed therein; and a sleeve, said sleeve being embedded in the body at a location spaced from the deck face, wherein a surface of said cylinder bore is formed by a portion of said body and an inner surface of said sleeve, said portion of the body including the arc recesses formed therein.

11. The cylinder block with a sleeve according to claim 10, wherein said sleeve and said body are made from an aluminum alloy.

12. A bore pin for use in casting a cylinder block with a sleeve said cylinder block having arc recesses formed at an intersection between a deck face joined to a cylinder head and a cylinder bore for avoiding interference with umbrella portions of valves mounted in the cylinder head comprising:

a first diameter portion for mating with the sleeve; and a second diameter portion for forming an opening end portion of a cylinder bore of the cylinder block, said second diameter portion being larger than said first diameter portion for forming the opening end portion of the cylinder bore having a larger diameter than an inner face of the sleeve and including projections formed thereon for forming the recesses simultaneously with the opening end portion of the cylinder bore.

* * * * *